United States Patent [19]

Katsumata et al.

[11] 3,980,922

[45] Sept. 14, 1976

[54] CAPACITANCE DISCHARGE TYPE BREAKERLESS IGNITION SYSTEM FOR AN INTERNAL COMBUSTION ENGINE

[75] Inventors: Mitsuo Katsumata; Katsuo Murakami; Mitsunori Miyamoto, all of Numazu, Japan

[73] Assignee: Kokusan Denki Co., Ltd., Numazu, Japan

[22] Filed: Jan. 27, 1975

[21] Appl. No.: 544,326

[30] Foreign Application Priority Data

Jan. 30, 1974 Japan ..... 49-12502[U]
Jan. 30, 1974 Japan ..... 49-12503[U]

[52] U.S. Cl. ..... 315/209 CD; 123/148 E; 315/209 SC

[51] Int. Cl.[2] ..... H05B 37/02; F02P 3/02

[58] Field of Search ..... 123/148 E; 315/209 CD, 315/209 SC

[56] References Cited

UNITED STATES PATENTS

| | | | |
|---|---|---|---|
| 2,461,321 | 2/1949 | Guillemin | 123/148 E |
| 3,312,860 | 4/1967 | Sturm | 315/209 CD X |
| 3,629,652 | 12/1971 | Maycock et al. | 315/209 CD X |

*Primary Examiner*—John Kominski
*Assistant Examiner*—Lawrence J. Dahl
*Attorney, Agent, or Firm*—Woodling, Krost, Granger & Rust

[57] ABSTRACT

A capacitance discharge type breakerless ignition system for an internal combustion engine, comprising ignition coil means including a main and an auxiliary primary coils and a secondary coil, capacitance means including two capacitances connected to said main and auxiliary primary coils, respectively to be charged by a charging voltage and at least one ignition plug connected to said secondary coil, time constants of said connections of said main primary coil and said corresponding capacitance and of said auxiliary primary coil and said corresponding capacitance when said capacitances are simultaneously discharged through said main and auxiliary primary coils being different from each other whereby said ignition plug is sparkingly discharged for a longer continuation time.

9 Claims, 4 Drawing Figures

CAPACITANCE DISCHARGE TYPE BREAKERLESS IGNITION SYSTEM FOR AN INTERNAL COMBUSTION ENGINE

BACKGROUND OF THE INVENTION

A capacitance discharge type breakerless ignition system for an internal combustion engine has been practically used which comprises an ignition coil means including a primary coil and a secondary coil, a capacitance connected to the primary coil of the ignition coil means to be charged by a charging voltage, a controlled semiconductor switching device to discharge the capacitance through the primary coil, a signal source to signal the semiconductor switching device to be turned on, and an ignition plug connected to the secondary coil of the ignition coil means to spark when the capacitance is discharged through the primary coil of the ignition coil means by the semiconductor switching device. In such capacitance discharge type breakerless ignition system, in the event that the ignition plug is covered with soot or contaminated, it often fails to spark, resulting in prevention of a normal operation of the engine. As well known, in order to possibly reduce the failure of sparking of the ignition plug to ensure the ignition of the engine, it is effective that the ignition plug is sparkingly discharged with an abrupt voltage rise for a longer continuation time so that the discharge energy increases. An abrupt voltage rise applied across the ignition plug is particularly desirable where the plug is wet. Because in such case the spark may fail to occur if the voltage does not rise abruptly.

U.S. Pat. No. 3,234,430 discloses an ignition system for an internal combustion engine which is adapted to make longer the continuation time of spark discharge of an ignition plug. The ignition system disclosed in this U.S. patent comprises a main capacitance connected in parallel to a primary coil of an ignition coil means to be charged by a high tension charging source and an additional capacitance or capacitances connected through a choke coil or coils between the main capacitance and the high tension charging means and in parallel to the main capacitance. In the disclosed system, when a controlled switching device is closed at the ignition time of the engine, the charges of the main and additional capacitances are discharged through the primary coil of the ignition coil means with respective time constants different from each other. Thus, the ignition plug connected to a secondary coil of the ignition coil means has the spark discharges when the main capacitance is discharged and the additional one when the additional capacitance or capacitances are discharged, both of which spark discharges are accomplished in superposition. Accordingly, the spark of the ignition plug continues for a longer time, resulting in increased discharge energy of the ignition plug.

However, the prior art has the disadvantage that since the choke coil or coils have a large sized shape and a heavy weight and also since they are required to have a high insulation, the structure of the apparatus is complicated in its construction and large in its shape and weight with the result that it is expensive, which must be avoided for application of such system to a breakerless ignition apparatus.

SUMMARY OF THE INVENTION

Accordingly, it is a principal object of the present invention to provide a capacitance discharge type breakerless ignition system for an internal combustion engine which is adapted to give an abrupt voltage rise across an ignition plug and to prolong the continuation time of spark discharge across an ignition plug with a simplified construction and without expensiveness.

In accordance with a typical embodiment of the present invention, an ignition coil means comprises a main primary coil and a secondary coil and further comprises an auxiliary primary coil having more turns than the main primary coil has. The secondary coil is connected to an ignition plug of an internal combustion engine and the non-grounded sides of the main and auxiliary primary coils are connected to two capacitances, respectively with the capacitances charged by a charging voltage. The capacitances are discharged through the main and auxiliary primary coils, respectively with respective time constants different from each other. The main primary coil and the capacitance connected thereto have a shorter time constant so that a primary or discharging current has an abrupt rise while the auxiliary primary coil and the capacitance connected thereto have a longer time constant so that a primary or discharging current has a gentle or delayed rise and long duration. These two currents are superposed on each other, so that the spark discharge of the ignition plug is ensured to continue even when the plug is wet, and to continue for a longer time. Therefore, the discharge energy of the ignition plug increases to ensure the ignition of the engine.

Another feature of the present invention is the provision of ignition coil means having a closed magnetic core, one of the leg portions of which has the main primary coil and the secondary coil thereon wound therearound and the other leg portion of which has the auxiliary primary coil wound therearound. With such arrangement of the ignition coil means, when it is compared with that of arrangement of the two primary coils and the secondary coil wound around the primary coils, the outside diameter of the secondary coil decreases so that it has a lower winding resistance and as a result the secondary coil has an impact current flowing therethrough at higher rate of rise. In addition, since the main and auxiliary primary coils are individually wound around the separate leg portions of the closed magnetic core they are loosely magnetic-coupled with each other by means of leakage of the magnetic flux from the core and the magnetic resistance, the current through the auxiliary primary coil is not affected by earlier rise of the primary current through the main primary coil. For a similar reason, the main and auxiliary primary coils can be prevented from interference with each other.

BRIEF DESCRIPTION OF THE DRAWINGS

The above and other objects and features of the present invention will be apparent from the description of the embodiments taken with reference to the accompanying drawings; in which.

DETAILED DESCRIPTION OF THE PREFERRED EMBODIMENTS

Figure 1:
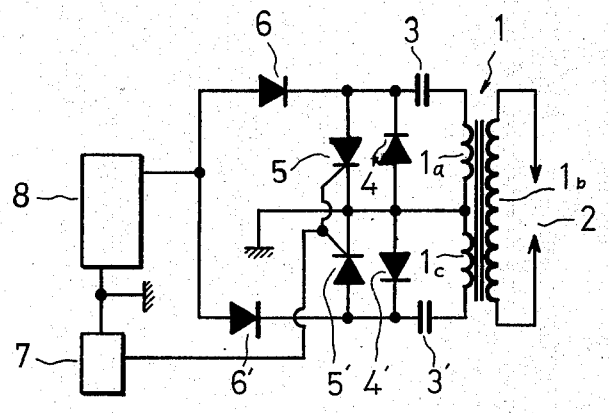
FIG. 1 is a circuit diagram of a capacitance discharge type ignition system embodying the present invention.
Figure 2:
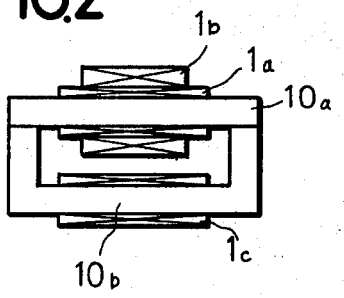
FIG. 2 is a schematic elevational view of an ignition coil useful for the ignition system of the present invention.

Referring now to FIG. 1, a capacitance discharge type breakerless ignition system of the present invention comprises ignition coil means 1 including a main primary coil 1*a* and a secondary coil 1*b* and further including an auxiliary primary coil 1*c*. In the preferred embodiment of the present invention, as shown in FIG. 2 the ignition coil means 1 may comprise a closed magnetic core 10 constructed in combination of an I-shaped core and a U-shaped core. The main primary coil 1*a* may be wound around one of the leg portions 10a of the core 10 and the secondary coil 1*b* is wound around the main primary coil 1*a* while the auxiliary primary coil may be wound around the other leg portion 10*b* of the core 10 with the auxiliary primary coil having more turns than those of the main primary coil 1*a* and preferably double the number of turns. As shown in FIG. 1, the secondary coil 1*b* has the ends connected to an ignition plug 2 of an internal combustion engine (not shown) and the main and auxiliary primary coils have respective one ends both connected to the ground and have respective other ends connected in series to one ends of respective capacitances 3 and 3'. The capacitances 3 and 3' have respective other ends connected to a common charging power supply 8 through respective diodes 6 and 6' forwardly disposed relative to the power supply so that they can be charged by the same. The power supply 8 may comprise an AC magneto generator driven by the engine. It should be noted that an inductance of the main primary coil 1*a* has a relatively lower value so that a primary current flows therethrough having an abrupt rise while an inductance of the auxiliary primary coil 1c has a relatively higher value so that a primary current flows therethrough having a longer continuation time. In the practical apparatus of the present invention, the capacitances 3 and 3' may have a value of $1\mu f$ and the main primary coil 1*a* may have 100 turns while the auxiliary primary coil may have 200 turns. We confirmed that a good result can be obtained by the above practical apparatus. It should be understood that the capacitance 3 connected to the main primary coil 1*a* may have a slightly higher value than the other capacitance 3' may have, in order to increase the discharge energy. Controlled semiconductor switching devices such as thyristors 5 and 5' are connected in parallel to the respective series connections of the main primary coil 1*a* and the capacitance 3 and of the auxiliary primary coil 1*c* and the capacitance 3' and the gates of the thyristors 5 and 5' are connected to a signal source 7 to produce a control signal in time with rotation of the engine.

In operation, when the control signal is output from the signal source at the ignition time of the engine, the thyristors 5 and 5' are conductive and accordingly, the charges of the capacitances 3 and 3' are discharged through the main and auxiliary primary coils 1*a* and 1*c*, respectively, with respective time constants different from each other. Thus, the ignition plug 2 is sparkingly discharged when the capacitance 3 is discharged and at the same time it is sparklingly discharged when the capacitance 3' is discharged so that the spark discharges are superposed, with the result that they continue for a longer time. Therefore, failure to ignite the engine can be effectively prevented so that the ignition can be ensured. The diodes 4 and 4' in parallel connection with the respective thyristors 5 and 5' serve to protect the thyristors from reverse voltage thereacross.

Figure 3:
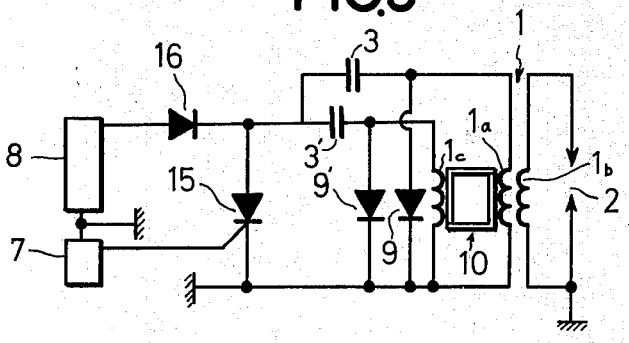
FIG. 3 is a circuit diagram of modification of the ignition system of the present invention.

FIG. 3 shows a modification of an ignition system of the present invention which is substantially identical to the embodiment of FIGS. 1 and 2, except that the thyristors 4 and 4' of FIG. 1 may be replaced by a single or common thyristor 15 and that the diodes 6 and 6' of FIG. 1 may be replaced by a single or common diode 16. The same numerals designate the same components. More particularly, the main and auxiliary primary coils 1*a* and 1*c*, which may have the one ends connected to the ground, may have the other ends connected to the one ends of the capacitances 3 and 3', respectively, the other ends of which may be connected through the single or common forwarded diode 16 to the power supply 8 so that they are charged. The single or common thyristor 15 may have the anode connected at the point between the cathode of the diode 16 and the other ends of the capacitances 3 and 3' and may have the cathode connected to the ground. The reverse voltage preventing diode 4 may be connected in parallel to the main primary coil 1*a* and similarly, the reverse voltage preventing diode 4' may be connected in parallel to the auxiliary primary coil 1*c*. It will be understood that the diodes 4 and 4' of FIG. 1 are eliminated in this modification and damping diodes 9 and 9' may be provided in parallel connection with the main and auxiliary primary coils 1*a* and 1*c* of the ignition coil means 1 as in a conventional manner. It will be understood that the operation of the modification is substantially identical to that of the embodiment of FIG. 1 and therefore, it will not be described hereinafter.

Figure 4:
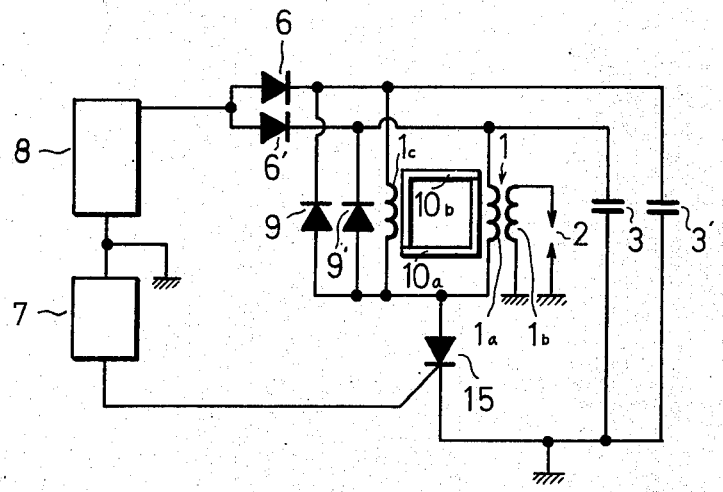
FIG. 4 is a circuit diagram of further modification of the ignition system of the present invention.

FIG. 4 shows another modification of an ignition system of the present invention which is also substantially identical to the embodiments of FIGS. 1 to 3, except that only the thyristors 5 and 5' of FIG. 1 are replaced by a single or common thyristor 15. Similarly, the same numerals designate the same components. In this modification, the main and auxiliary primary coils 1a and 1c may have the one ends connected to the one ends of the capacitances 3 and 3' and also to the cathodes of the diodes 6 and 6' and may have the other ends connected to the anode of the single thyristor 15. The other ends of the capacitances 3 and 3' and the cathode of the thyristor 15 may be connected to the ground. The operation of the modification will not be described because it is substantially identical to that of the embodiment of FIG. 1.

While some preferred embodiments of the present invention have been illustrated and described with reference to the accompanying drawing, it should be understood that they are by way of examples and that various changes and modifications may be made within the spirit and scope of the present invention, which is intended to be defined only by the appended claims.

What is claimed is:

1. A capacitance discharge type breakerless ignition system for an internal combustion engine comprising ignition coil means, including a main primary coil, an auxiliary primary coil and a secondary coil, at least one ignition plug connected to said secondary coil, a first capacitance connected in series with said main primary coil, a second capacitance connected in series with said auxiliary primary coil, controlled semiconductor switching means for discharging said first and second capacitances through said main and auxiliary primary coils, respectively when said semiconductor switching means conducts at the ignition time of an internal combustion engine, and a signal source for supplying a control signal in time with rotation of the engine to said controlled semiconductor switching means, a series circuit of said main primary coil and said first capacitance having a short time constant so as to provide an abruptly rising voltage across said secondary coil, and a series circuit of said auxiliary primary coil and said second capacitance having a long time constant so as to provide a long duration of voltage across said secondary coil.

2. A capacitance discharge type breakerless ignition system as set forth in claim 1, wherein said auxiliary primary coil has more turns than those of said main primary coil.

3. A capacitance discharge type breakerless ignition system as set forth in claim 1, wherein said ignition coil means comprises a closed magnetic core, one of the leg portions of which has said main primary coil wound therearound and said secondary coil wound on said main primary coil and the other leg portion of which has said auxiliary primary coil wound therearound.

4. A capacitance discharge type breakerless ignition system as set forth in claim 1, wherein each of said first and second capacitances has a first end connected in series to said main and auxiliary primary coils, respectively, and has a second end connected through respective diodes to said charging power supply.

5. A capacitance discharge type breakerless ignition system as set forth in claim 1, wherein said controlled semiconductor switching means comprises two semiconductor switching devices, one of which is connected in parallel to a series connection of said main primary coil and said first capacitance and the other of which is connected in parallel to a series connection of said auxiliary primary coil and said second capacitance.

6. A capacitance discharge type breakerless ignition system as set forth in claim 1, wherein each of said first and second capacitances has a first end connected in series to said main and auxiliary primary coils, respectively, and has a second end connected through a single diode to said charging power supply.

7. A capacitance discharge type breakerless ignition system as set forth in claim 1, wherein said controlled semiconductor switching means comprises a single semiconductor switching device to which are connected in parallel two series connections of said main and auxiliary primary coils and said corresponding capacitances.

8. A capacitance discharge type ignition system as set forth in claim 1, wherein each of said first and second capacitances has a first end connected to the ground and has a second end connected through respective diodes to said charging power supply.

9. A capacitance discharge type ignition system as set forth in claim 1, wherein said controlled semiconductor switching means comprises a single semiconductor switching device, one end of which is connected to one end of said capacitances and the other end of which is connected to said main and auxiliary primary coils, and the other ends of said capacitances are connected to the other ends of said main and auxiliary primary coils, respectively.

* * * * *